US012276484B2

(12) United States Patent
Aguirre

(10) Patent No.: US 12,276,484 B2
(45) Date of Patent: Apr. 15, 2025

(54) ARCHERY TARGET LAUNCHING DEVICE

(71) Applicant: Jerry Aguirre, Trinidad, CO (US)

(72) Inventor: Jerry Aguirre, Trinidad, CO (US)

( * ) Notice: Subject to any disclaimer, the term of this patent is extended or adjusted under 35 U.S.C. 154(b) by 97 days.

(21) Appl. No.: 18/188,097

(22) Filed: Mar. 22, 2023

(65) Prior Publication Data

US 2023/0304776 A1 Sep. 28, 2023

Related U.S. Application Data

(60) Provisional application No. 63/322,604, filed on Mar. 22, 2022.

(51) Int. Cl.

| | |
|---|---|
| ***A63B 69/40*** | (2006.01) |
| ***F41B 4/00*** | (2006.01) |
| ***F41B 7/08*** | (2006.01) |
| ***F41J 9/30*** | (2006.01) |

(52) U.S. Cl.

CPC ..... *F41J 9/30* (2013.01); *A63B 69/40* (2013.01); *F41B 4/00* (2013.01); *F41B 7/08* (2013.01)

(58) Field of Classification Search

CPC ..... F41J 9/30; F41J 9/18; F41B 7/08; F41B 4/00; A63B 69/40; A63B 69/406

See application file for complete search history.

(56) References Cited

U.S. PATENT DOCUMENTS

| | | | | |
|---|---|---|---|---|
| 4,699,116 A | | 10/1987 | Freeland | |
| 5,947,101 A | * | 9/1999 | Kerr | F41B 4/00 124/78 |
| 5,996,564 A | * | 12/1999 | Kotowski | F41B 4/00 124/6 |
| 6,026,796 A | * | 2/2000 | LaPorte | F41J 9/18 124/8 |
| 6,116,229 A | * | 9/2000 | Wu | F41B 4/00 124/6 |
| 6,237,583 B1 | * | 5/2001 | Ripley | A63B 69/406 124/78 |
| 8,899,216 B2 | | 12/2014 | Laporte | |
| 8,997,727 B1 | * | 4/2015 | Hamel | A63H 33/18 124/16 |
| 9,004,052 B1 | * | 4/2015 | Poirier | F41B 7/006 124/47 |
| 9,057,589 B2 | | 6/2015 | Laporte | |
| 9,086,257 B2 | | 7/2015 | Laporte | |
| 9,945,644 B2 | | 4/2018 | Fouques | |
| 11,015,896 B1 | * | 5/2021 | Hochberg | A63B 69/406 |

(Continued)

FOREIGN PATENT DOCUMENTS

| | | |
|---|---|---|
| CN | 206934759 | 1/2018 |
| WO | 2011138341 | 11/2011 |
| WO | 2012032001 | 3/2012 |

*Primary Examiner* — John E Simms, Jr.

(74) *Attorney, Agent, or Firm* — Leyendecker & Lemire, LLC

(57) ABSTRACT

An archery target launching device is described. Embodiments of the archery target launching device can include a frame and a launch assembly. The frame can allow for the target launching device to be implemented in a vertical orientation and a horizontal orientation. In the horizontal orientation, the frame can rotate approximately 110 degrees to provide a variety of launch angles. In the vertical orientation, a plurality of legs of the frame can be implemented to alter a launch angle.

17 Claims, 5 Drawing Sheets

(56) References Cited

U.S. PATENT DOCUMENTS

| | | | | |
|---|---|---|---|---|
| 2005/0227580 | A1* | 10/2005 | Zuloff | F41B 7/08 446/473 |
| 2006/0086345 | A1* | 4/2006 | Wu | F41B 4/00 124/6 |
| 2009/0229158 | A1* | 9/2009 | Victor | F41A 9/70 42/49.01 |
| 2011/0260404 | A1 | 10/2011 | Laporte | |
| 2013/0104867 | A1* | 5/2013 | Laporte | F41J 9/20 124/41.1 |
| 2013/0112184 | A1* | 5/2013 | Corsiglia | F41B 4/00 124/78 |
| 2014/0283809 | A1* | 9/2014 | Huebl | F41B 11/60 124/56 |
| 2019/0212108 | A1 | 7/2019 | Laporte | |

* cited by examiner

ARCHERY TARGET LAUNCHING DEVICE

CROSS-REFERENCE TO RELATED APPLICATION

This application claims the benefit of U.S. Provisional Application No. 63/322,604, filed Mar. 22, 2022.

BACKGROUND

Archery target practice is an enjoyable activity engaged in by many hunters that involves launching an archery target (e.g., foam disc) into the air (or along the ground) to be aimed at with an arrow. Most archery target launchers implement spring loaded arms to throw the archery targets and are either handheld devices or large heavy machines. Currently available archery target launchers allow for some modification of a position of the launcher so as to vary the flight path of deployed targets, but it is cumbersome and time consuming. In addition, adjusting current archery target launchers is difficult and awkward because of weight and size.

A portable, easily adjustable, multi-target storing archery target launching device that provides easy adjustability of a trajectory of archery targets launched by the target launching device is needed.

DETAILED DESCRIPTION

Figure 1:
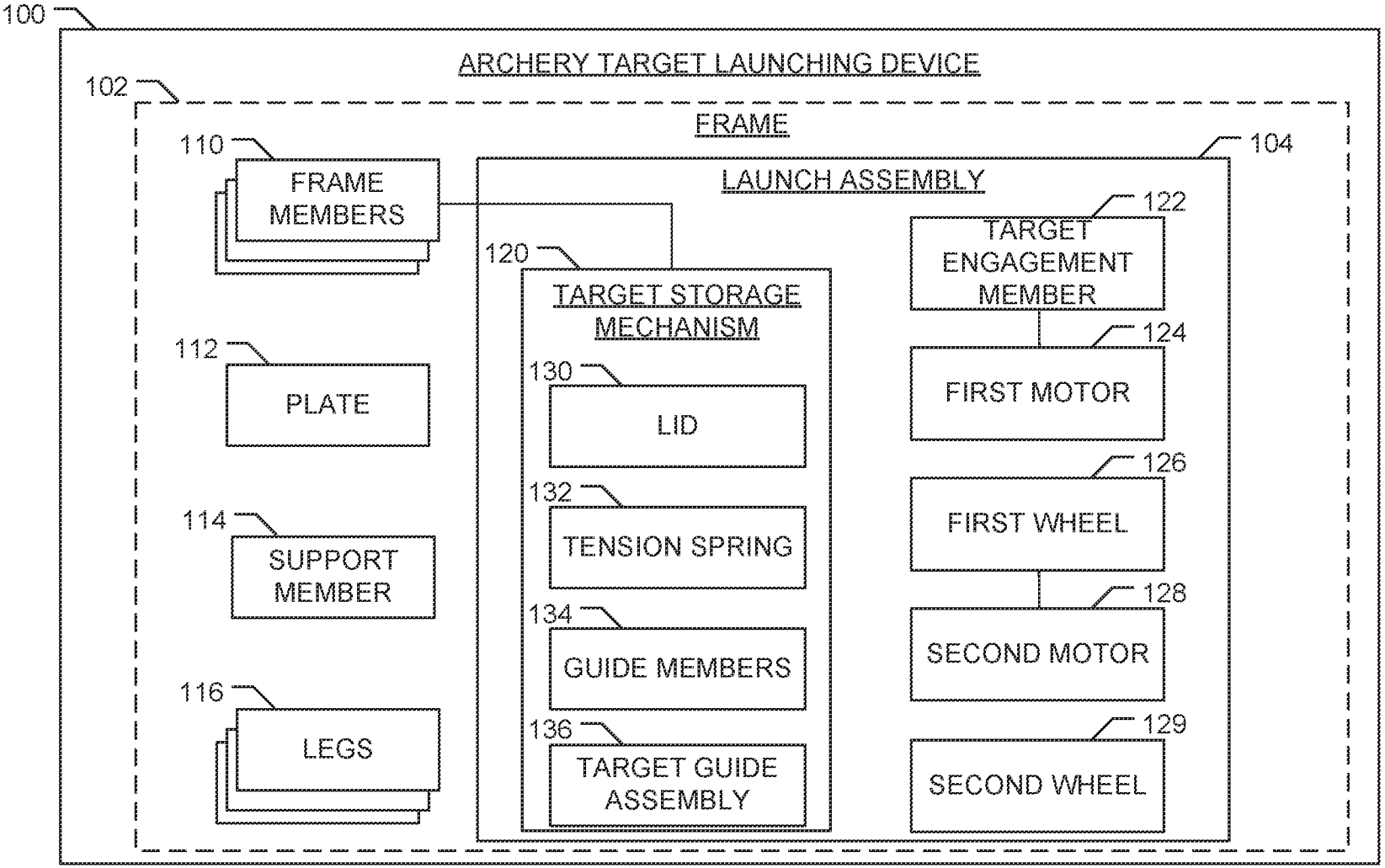
FIG. 1 is a block diagram of an archery target launching device according to one embodiment of the present invention.

Embodiments of the present invention include a multi-positional archery target launching device. The archery target launching device can be implemented to launch an archery target at a variety of different angles and in different orientations. For instance, a target may be launched to run along the ground or may be launched into the air in a vertical orientation. In another instance, a target can be launched similar to a skeet target (e.g., similar to a frisbee) in a horizontal orientation.

The target launching device can be implemented in either a vertical orientation or a horizontal orientation. Typically, the vertical orientation can be implemented to launch targets similar to skeet targets where the targets are oriented substantially horizontally. The horizontal orientation can be implemented to launch targets into the air and along the ground where the targets are oriented substantially vertically. Of note, in either the horizontal orientation or the vertical orientation, the target launching device can be manipulated to adjust a launch angle of targets. The targets can generally be foam discs, but other shapes and materials are contemplated. For instance, metal discs are contemplated for use with small caliber firearms.

In one embodiment, the target launching device can include, but is not limited to, a frame and a launch assembly. The launch assembly can be integrated with the frame to form the target launching device. Generally, the frame can have a substantially semi-cylindrical "U" shape. The semi-cylindrical shape can allow the frame to be rolled when in a horizontal orientation. As can be appreciated, this can allow for targets to be launched at varying angles as the frame is rolled. In one instance, the frame can alter a launch angle approximately 110 degrees. The frame can include a stabilizer proximate a bottom of the frame to keep the frame from rotating when in a selected position by a user. The launch assembly can be implemented to store and launch one or more targets.

In one embodiment, the frame can include, but is not limited to, a plurality of frame members, a plate, a support member, and a plurality of legs. The plurality of frame members can be implemented to form a portion of the launch assembly and create the overall shape of the frame. The plate can be located proximate a bottom of the plurality of frame members and form a base for the launch assembly to couple thereto. The plurality of legs can be located on a bottom of the plate. The plurality of legs can be implemented to alter a launch angle of a target when the frame is oriented vertically. For example, the plurality of legs can be implemented to angle the launch assembly when the target launching device is in the vertical orientation. In one example, at least one of the plurality of legs can be adjustable in length. As can be appreciated, this can allow a user to adjust an angle that targets are launched at when the target launching device is in the vertical orientation. The support member can be located proximate a top (or distal ends) of the plurality of frame members and can have a generally semi-cylindrical shape. The support member and the plate can be implemented to support the target launching device when in the horizontal orientation. Further, a portion of a periphery of the plate can be substantially similar to a shape of the support member. As can be appreciated, the target launching device can roll along a surface of the plate and the support member. Of note, an overall profile of the support member and a portion of the plate can be substantially similar. Embodiments are contemplated where the plate and support member can be swapped to allow for a different peripheral profile. As can be appreciated, this may allow for different launch angles based on a shape of the plate and the support member.

Components of the launch assembly can be coupled to the plate of the frame. The launch assembly can include, but is not limited to, a target storage mechanism, a target engagement member, a first motor, a second motor, and a wheel. The target storage mechanism can be implemented to store one or more targets under compression such that a bottom target is placed proximate the target engagement member after a target has been launched. The target engagement member can be implemented to push a target to engage the wheel. When the target is engaged by the wheel, the wheel can launch the target. The first motor can be operatively coupled to the target engagement member and the second motor can be operatively coupled to the wheel. In some embodiments, components of the frame and the launch assembly can be removably coupled to the plate. In such an embodiment, different sized components can be swapped to allow for more or less storage of targets. For example, an overall height of the frame and the launch assembly can be changed to allow for more or less targets.

The launch assembly can further include a means for activating the target engagement member via the first motor. As can be appreciated, the first motor can rotate the target engagement member when activated. In one instance, a switch can be implemented to activate the target engagement member. For example, the switch may include a toggle that can be manipulated by a user to activate the first wheel to rotate the target engagement member. In some instances, the switch may be wirelessly connected to the first motor. In some instances, a control module can be implemented to activate the first motor in predetermined time intervals for a set amount of time or until a user instructs the control module to stop activating the first motor. As can be appreciated, this may allow for an automatic launching of a set of archery targets without further engagement from a user.

In some embodiments, a speed of the wheel and the target engagement member can be controlled via timers calibrated with a potentiometer. For example, at low speeds the second motor can turn on for 0.5 seconds and the first motor can turn on 0.5 seconds after the second motor turns off. In a high-speed setting, the second motor can turn on for 1.2 seconds and the first motor can turn on immediately after the second motor turns off. Of note, the first motor can use the inertia of the second motor to make it easier on the electrical components. In one example, a pulse width modulation speed control can be implemented to control a speed of the first motor and the second motor.

In one embodiment, the target storage mechanism can incorporate the frame members, a lid, a tension spring, and a pair of guide members. The tubes of the frame can be configured to interface with the targets such that they do not pass through the frame but can be inserted into the frame and can be launched from the frame. Stated alternatively, an opening of the frame members can be slightly larger than a diameter of a target and at least one frame member can be implemented to stop the targets from passing through the frame. The lid can be operatively connected to the tension spring and the pair of guide members. When the lid is moved away from the plate, targets can be inserted into the target storage mechanism below the lid. The tension spring can then provide a compressive force to lid which can then engage the targets. As a target is launched from the target launching device, the lid can be moved towards a bottom of the frame via the tension spring. It is to be appreciated that other means of providing a downward force to the targets are contemplated and not outside a scope of the present disclosure. For instance, the lid may be heavily weighted to provide a necessary force to move the targets downward after a target has been launched. The pair of guide members can be implemented to keep the lid in position when moving along a length of the frame.

Of note, the target launching device can be configured to rotate approximately 110 degrees when in the horizontal orientation. When in the horizontal orientation, an edge of the plate and the support member can interface with a surface the target launching device is resting on. As can be appreciated, a profile of the plate and the support member can allow for the target launching device to be rolled easily.

In some embodiments, the target launching device can implement a stabilizer to stabilize the target launching device. In one instance, the stabilizer can be implemented to support the target launching device at a preferred angle after being rolled. In a typical implementation, the target launching device can be rolled to a preferred angle (when oriented horizontal), and then the stabilizer can be deployed to keep the target launching device at the preferred angle. For instance, a user can roll the target launching device to a preferred launch angle, and then the user can engage the stabilizer to keep the target launching device at the preferred launch angle. As previously mentioned, the target launching device can be configured to roll on the plate and the support member. Of note, the stabilizer can support a weight of the target launching device while keeping the preferred launch angle. In one embodiment, a ratchet can be implemented as the stabilizer to allow a user to incrementally increase (or decrease) the launch angle. It is to be appreciated that other mechanical mechanisms are contemplated to allow for incremental changes in the launch angle. In another embodiment, a mechanical mechanism can be implemented as the stabilizer that may allow for a smooth transition between angles.

In one embodiment, a target launching device can include a launch assembly and a frame. The launch assembly can be adapted to store and launch a target. The frame can be defined by a base plate, a plurality of frame members, a support member, and a plurality of legs. The base plate can include two adjacent sides having rounded corners. The plurality of frame members can extend from a top side of the plate and form a substantially "U" shape. The support member can be coupled to distal ends of the plurality of frame members. The support member can have a substantially "U" shape and sized similarly to the two adjacent sides having rounded corners of the base plate. The plurality of legs located on a bottom side of the plate. The frame can be substantially vertical in a first orientation and can be substantially horizontal in a second orientation. In the first orientation, the target launching device can be supported by the plurality of legs. In the second orientation, the target launching device can be supported by the plate and the support member. The frame can be adapted to be rolled approximately 110 degrees when in the second orientation. The launch assembly can be defined by a target storage mechanism, a target engagement member, a wheel, a first motor, and a second motor. The first motor can be operatively connected to the target engagement member. The second motor can be operatively connected to the wheel. The wheel can be adapted to engage and launch a target. The target engagement member can be adapted to push a target to engage the wheel. The target storage mechanism can include a lid, a tension spring, a pair of guide members, a target guide assembly, and the plurality of frame members. The frame can further include a stabilizer. At least one of the plurality of legs is adjustable in length.

In a second embodiment, an archery target launching device can include a launch assembly and a frame adapted to be substantially vertical in a first orientation and substantially horizontal in a second orientation. The frame can be defined by a base plate, a plurality of frame members, a support member, and a plurality of legs. The plurality of frame members can extend from a top side of the plate and form a substantially "U" shape. The support member can be coupled to a distal end of each of the plurality of frame members. The support member can have a substantially "U" shape. The plurality of legs can be located on a bottom side of the plate. A portion of a periphery of the base plate can be shaped substantially similar to a shape of the support member. The frame can further include a stabilizer adapted to stabilize the target launching device. The launch assembly can be adapted to launch a disc shaped target. The disc shaped target can be launched in a substantially horizontal orientation when the frame is in the first orientation. The disc shaped target can be launched in a substantially vertical orientation when the frame is in the second orientation. The target launching device can be adapted to rotate approximately 110 degrees when the frame is in the second orientation. The launch assembly can include a target guide assembly. The target guide assembly defined by a pair of base members and a restrictor member. The pair of base members can be adapted to interface with a first target. The pair of base members can be spaced apart and can extend vertically from a top of the plate. The restrictor member can be adapted to engage and block a second target located above the first target.

In a third embodiment, an archery target launching device can include a frame and a launch assembly. The frame can be adapted to be substantially vertical in a first orientation and substantially horizontal in a second orientation. The frame can be defined by a base plate, a plurality of frame members, a support member, and a plurality of legs. The plurality of frame members can extend from a top side of the plate and form a substantially "U" shape. The support member can be coupled to a distal end of each of the plurality of frame members. The support member can have a substantially "U" shape. The plurality of legs can be located on a bottom side of the plate. The launch assembly can be integrated with the frame. The launch assembly can be defined by a target storage mechanism, a target engagement member, a wheel, a first motor, and a second motor. The first motor can be operatively connected to the target engagement member. The second motor can be operatively connected to the wheel.

Embodiments of the archery target launching device can be adapted to work with a variety of power sources. For instance, a battery can be implemented to power components of the device. In another instance, the archery target launching device can be connected to a power outlet. In one example embodiment, the components of the device can be powered by a variety of voltages between 12-20 volts DC.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or reflationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

An Embodiment of an Archery Target Launching Device

Figure 2A:
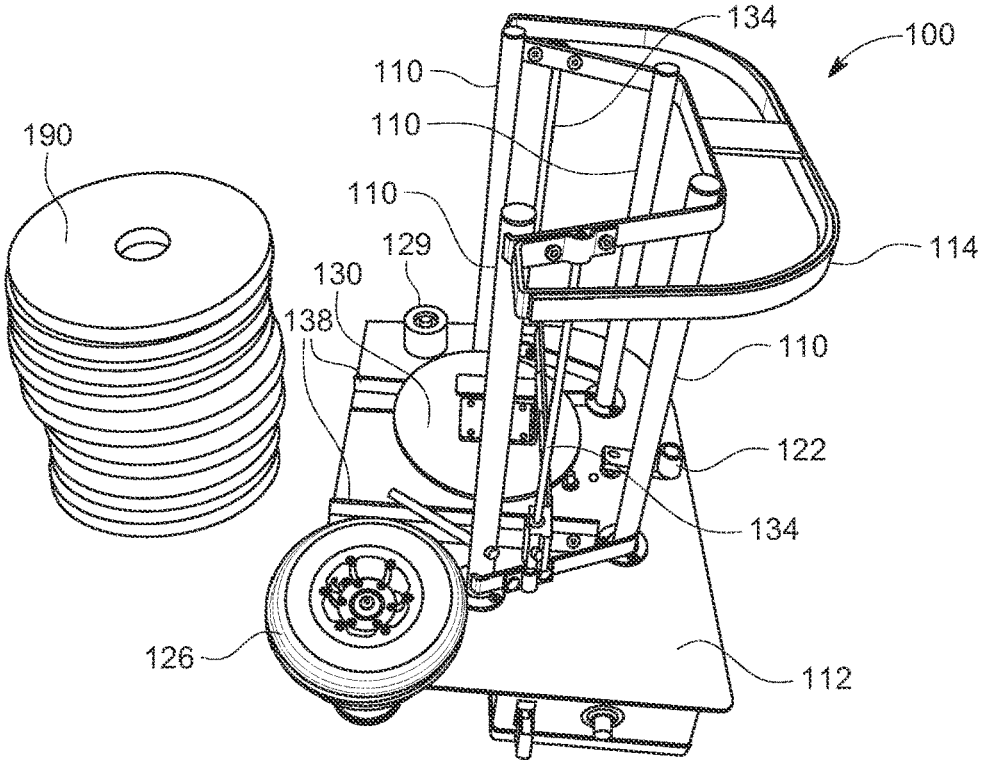
FIG. 2A is a side perspective view of an archery target launching device in a vertical orientation according to one embodiment of the present invention.
Figure 2B:
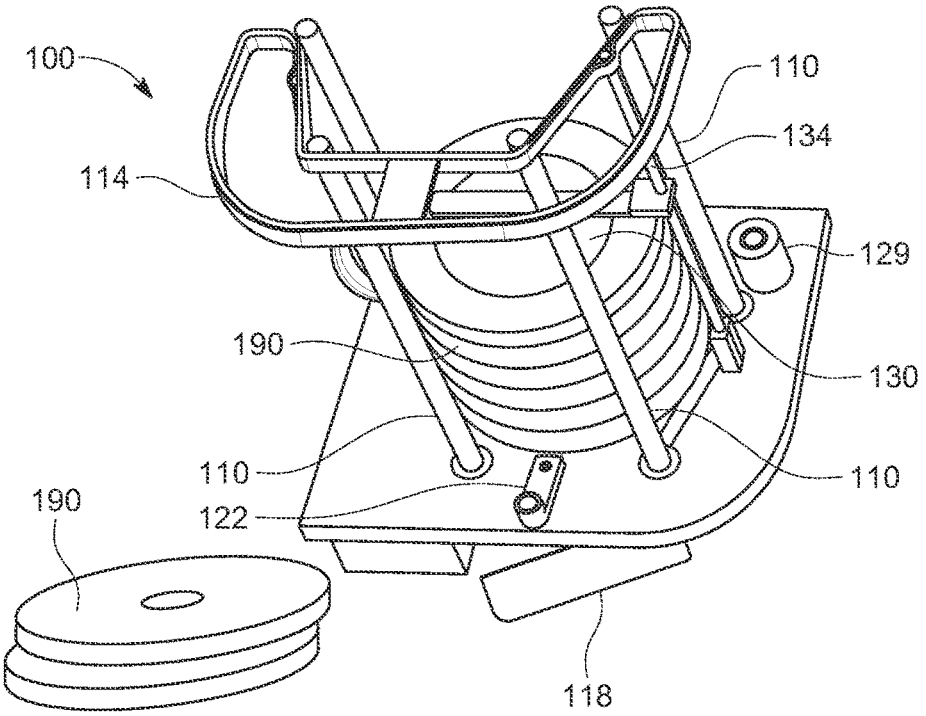
FIG. 2B is a back perspective view of an archery target launching device in a vertical orientation according to one embodiment of the present invention.
Figure 2C:
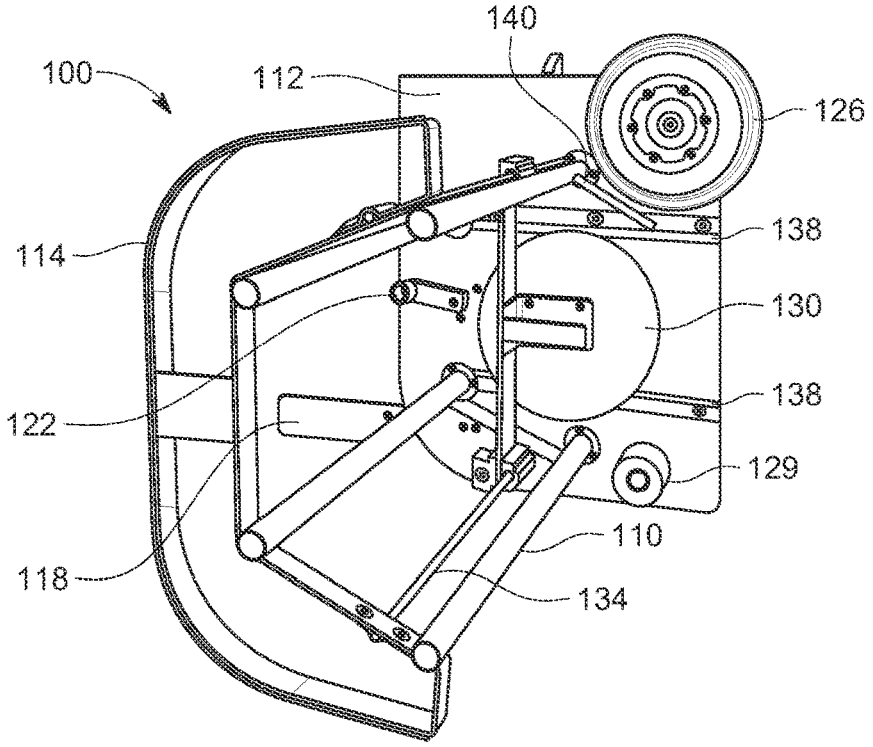
FIG. 2C is a side perspective view of an archery target launching device in a horizontal orientation according to one embodiment of the present invention.
Figure 2D:
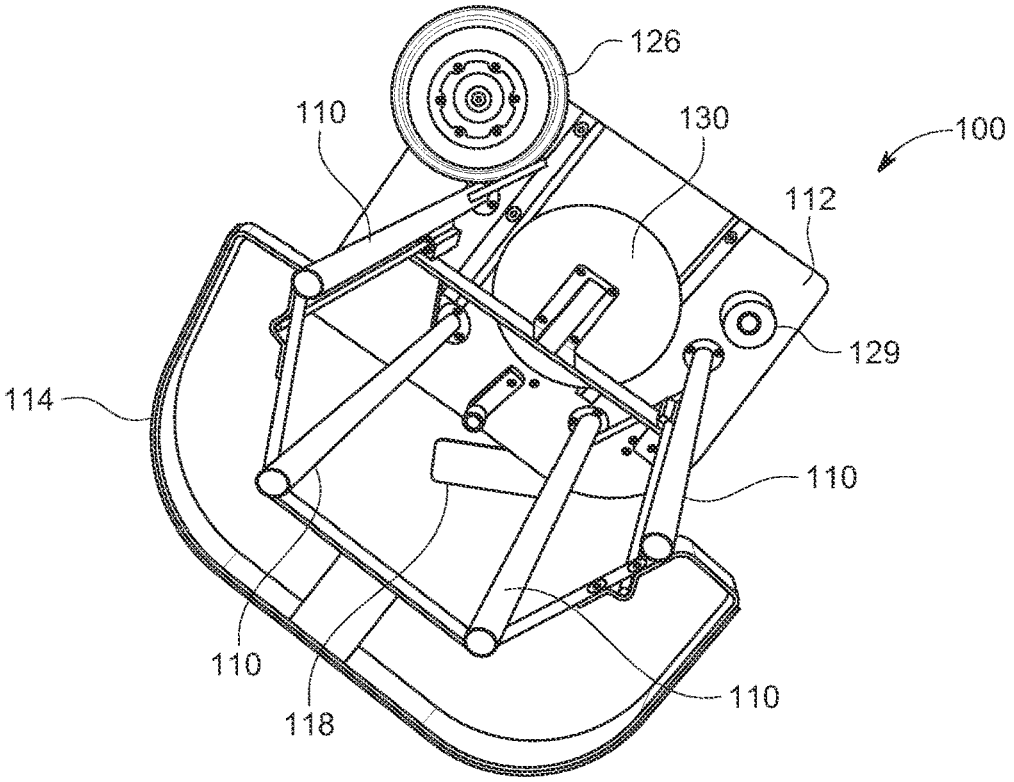
FIG. 2D is a side perspective view of an archery target launching device in a horizontal orientation according to one embodiment of the present invention.

Referring generally to FIGS. 1-2D, detailed diagrams of a first embodiment 100 of an archery target launching device are illustrated. FIG. 1 includes a block diagram of the archery target launching device 100. FIG. 2A shows the archery target launching device 100 in a first vertical orientation. FIG. 2B shows the archery target launching device 100 in a second vertical orientation. FIG. 2C shows the archery target launching device 100 in a first horizontal orientation. FIG. 2D shows the archery target launching device 100 in a second horizontal orientation. The archery target launching device 100 can be implemented to launch archery targets in different orientations and at a variety of different angles. For example, the archery target launching device 100 can be implemented to launch archery targets oriented horizontally or vertically.

As shown in FIG. 1, the archery target launching device 100 can include, but is not limited to, a frame 102 and a launch assembly 104. The launch assembly 104 can be integrated with the frame 102 to form the archery target launching device 100. As generally shown in FIGS. 2A-2D, the frame 102 can be shaped to allow for the launching device 100 to rotate approximately 110 degrees when in a horizontal orientation. The launch assembly 104 can be adapted to launch an archery target 190. Typically, the archery target 190 can have a disc shape. In one instance, the target 190 can be a foam discs. In one example, the foam disc can be modified with a band surrounding a peripheral edge of the foam disc. The band can be implemented to protect the foam disc along with providing a surface to engage the launch assembly 104. For instance, a piece of rubber can be sized to fit around the peripheral edge of the foam disc and secured to the foam disc.

The frame 102 can include, but is not limited to, a plurality of frame members 110, a plate 112, a support member 114, and a plurality of legs 116. In some embodiments, the frame 102 can further include a stabilizer 118. The stabilizer 118 can be implemented to help stabilize the target launching device 100 in a variety of different orientations. The plurality of frame members 110 can extend from a top side of the plate 112. The plurality of legs 116 can be coupled to a bottom side of the plate 112. The support member 114 can be coupled to a distal end of each of the plurality of frame members 110. The support member 114 can be implemented to provide a support surface when the target launching device 100 is in a horizontal orientation. An overall shape of the plurality of frame members 110, the plate 112, and the support member 114 can be an approximately semi-cylindrical shape. As can be appreciated, the plate 112 and the support member 114 can provide two points of contact while the target launching device 100 is in the horizontal orientation.

Typically, the plurality of frame members 110 can be manufactured from a rigid material. In some instances, to the rigid material can be a metallic tube. In other instances, a solid rigid bar or other structurally rigid member can be implemented. It is to be appreciated that one or more factors can be prioritized when deciding which materials are used to manufacture components of the target launching device 100. The one or more factors can include weight, strength, rigidity, etc. Generally, one of the factors can be prioritized depending on a specific implementation of the target launching device 100. For example, lighter weight materials may be prioritized for one embodiment where weight savings is a priority. In another example, an overall strength and durability may be prioritized when weight is not an issue.

The support member 114 can be manufactured from a rigid material and can have a generally semi-cylindrical shape. In some instances, the support member 114 may include a semi-rigid cover to protect a surface the target launching device 100 may be used on. As can be appreciated, the semi-rigid surface can also protect the rigid structure of the support member 114 from rough surfaces (e.g., concrete). The semi-cylindrical shape can allow for the target launching device 100 to rotate approximately 110 degrees when oriented horizontally. The stabilizer 118 can be implemented to provide support to the target launching device 100 after being rolled to a preferred launch angle.

As shown in FIG. 1, the launch assembly 104 can include, but is not limited to, a target storage mechanism 120, a target engagement member 122, a first motor 124, a first wheel 126, a second motor 128, and a second wheel 129. The components of the launch assembly 104 can be coupled to the plate 110 of the frame 102. Generally, the target storage mechanism 120, the target engagement member 122, and the first wheel 126 can be coupled to a top side of the plate 110. The first motor 124 and the second motor 128 can be coupled to a bottom side of the plate 110. The first motor 124 can be operatively connected to the target engagement member 122 and the second motor 128 can be operatively connected to the first wheel 126.

The target storage mechanism 120 can be implemented to store one or more targets 190 under compression. The target storage mechanism 120 can be configured such that a bottom target can be placed proximate the target engagement member 122 after a target 190 has been launched. The target engagement member 122 can be implemented to push a target 190 to engage the first wheel 126. When the target 190 is engaged by the first wheel 126, the first wheel 126 can engage the target 190 to launch the target 190.

The launch assembly 104 can further include a means for activating the target engagement member 122. As previously mentioned, the first motor 124 can be operatively connected to the target engagement member 122 such that the first motor 126 can be implemented to rotate the target engagement member 122. When rotated, the target engagement member 122 can be adapted to engage a target 190 during a rotation. In one instance, a switch can be implemented to activate the first motor 124 which can rotate the target engagement member 122. For example, the switch may include a toggle that can be manipulated by a user to activate the first motor 124. In some instances, the switch may be wirelessly connected to the first motor 124. In another instance, the first motor 124 can be activated and then proceed to rotate the target engagement member 122 at predetermined time intervals for a set amount of time. The second wheel 129 can be implemented to engage a target 190 on an opposite that the first wheel 126 may engage a target 190. In some instances, the second wheel 129 can be biased so as to provide a force to a target 190. For example, a spring may be implemented to bias the second wheel 129 towards the first wheel 126. As a target 190 moves past the second wheel 129, the second wheel 129 can be pushed out while still applying a force to the target 190. Of note the second wheel 129 can freely rotate.

In one embodiment, a control module can be implemented to determine when to turn the first motor 124 and the second motor 128 on and off. A switch can be operatively connected (wired or wirelessly) to the control module 124 which can be activated by a user. The control module may include simple logic to turn the first motor 124 and the second motor 128 on and off based on receiving a signal from the switch. In some embodiments, a speed of the first wheel 126 and the target engagement member 122 can be controlled via timers calibrated with a potentiometer. For example, at low speeds, the second motor 128 can turn on for 0.5 seconds and the first motor 124 can turn on 0.5 seconds after the second motor 128 turns off. In a high-speed setting, the second motor 128 can turn on for 1.2 seconds and the first motor 124 can turn on immediately after the second motor 128 turns off. Of note, the first motor 124 can use the inertia of the second motor 128 to make it easier on the electrical components. In one example, a pulse width modulation speed control can be implemented to control a speed of the first motor 124 and the second motor 128.

The target storage mechanism 120 can include, but is not limited to, the plurality of frame members 110, a lid 130, a tension spring 132, a pair of guide members 134, and a target guide assembly 136. The plurality of frame members 110 can be configured to form a frame for the target engagement mechanism 122. The targets 190 can be inserted into the plurality of frame members 110 such that the targets 190 do not pass through the frame members 110 but can be inserted into the frame 102 and can be launched from the frame 102.

The lid 130 can be operatively connected to the tension spring 132 and the pair of guide members 134. The guide members 124 can be implemented to guide and keep the lid 130 located substantially centered on one or more targets 190 inserted into the target storage mechanism 120. The lid 130 can be configured to move vertically along a length of the guide members 124. As can be appreciated, the lid 130 can move away from a top of the plate 112 to allow for targets 190 to be inserted into the target storage mechanism 120. The tension spring 132 can be connected to the lid 130 to provide a compressive force to the targets 190 when the lid 130 may be moved vertically away from a top of the plate 112.

The target guide assembly 136 can be implemented to provide a launch surface and a means for separating a first target to be launched from a second target on top of the first target. The target guide assembly 136 can include, but is not limited to, a pair of base members 138 and a restrictor member 140. The pair of base members 138 can be implemented to elevate a target to be launched above a surface of the plate 112. The restrictor member 140 can be implemented to block a target located on top of a target to be launched. Generally, the base members 138 can be spaced apart and include a minimum top surface to minimally engage a bottom of the target to be launched. As can be appreciated, this can allow for minimum surface friction between the target and the top of the base members 138. The restrictor member 140 can help prevent a second target from being launched with the first target actively being launched.

FIG. 2A shows the archery target launching device 100 in a first vertical orientation with a plurality of targets 190. In the vertical orientation, the target launching device 100 can rest on the legs 116. Of note, a launch angle of the target launching device 100 can be adjusted by altering a height of one or more of the legs 116. As shown in FIG. 2B, a launch angle of the archery target launching device 100 can be oriented upwards by adjusting the legs 116. The stabilizer 118 can be implemented to stabilize the target launching device 100.

FIG. 2C shows the archery target launching device 100 in a first horizontal orientation. As previously mentioned, when in the horizontal orientation, the target launching device 100 can be configured to rest on the engagement member 114 and an edge of the plate 112. FIG. 2D shows the archery target launching device 100 in a second horizontal orientation. As can be appreciated from FIGS. 2C and 2D, the target launching device 100 may rotate from the orientation in FIG. 2C to the orientation in FIG. 2D. The stabilizer 118 can be implemented to help keep the target launching device 100 stable. A target launched from the target launching device 100 oriented as shown in FIG. 2C would be adapted to roll along the ground similar to a small game animal. The target would be oriented vertically and would roll along an edge of the target. A target launched from the target launching device 100 as oriented in FIG. 2D, would be launched vertically into the air at an approximate angle of the launch assembly 102.

Figure 3A:
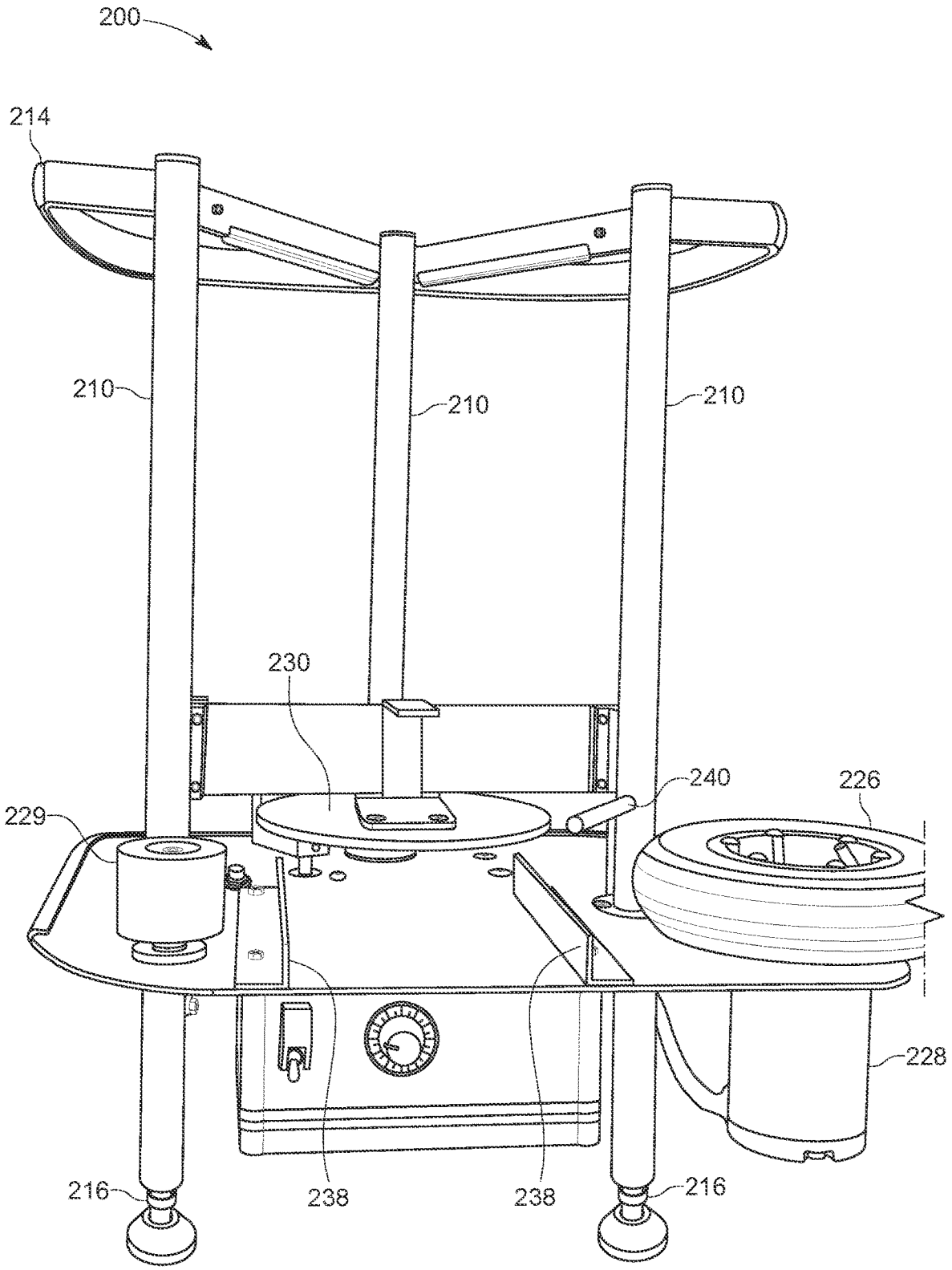
FIG. 3A is a front view of an archery target launching device according to one embodiment of the present invention.
Figure 3B:
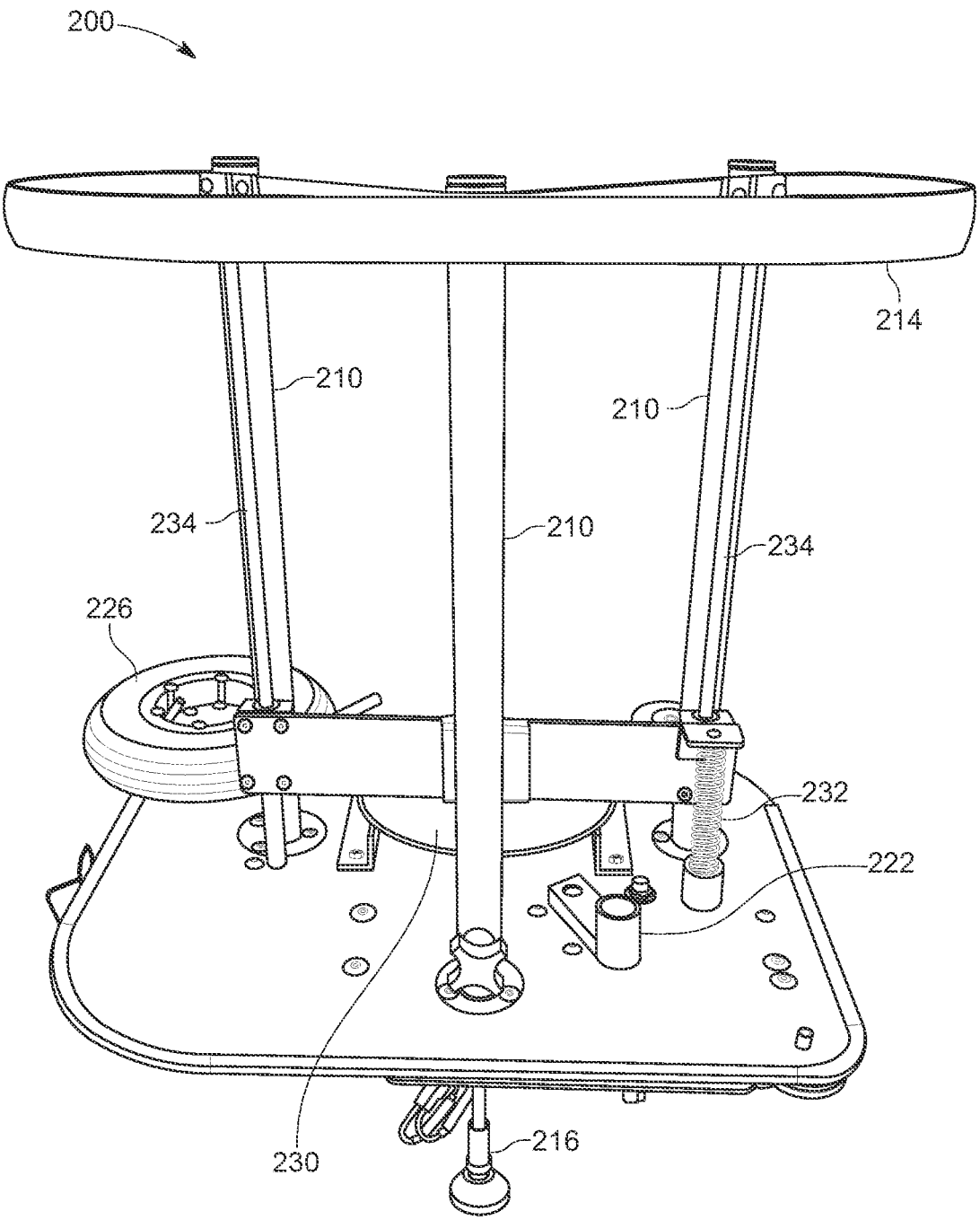
FIG. 3B is a back view of an archery target launching device according to one embodiment of the present invention

Referring to FIGS. 3A-3B, detailed diagrams of a second embodiment 200 of an archery target launching device are illustrated. The second embodiment archery target launching device 200 can be substantially similar to the first embodiment archery target launching device 100. FIG. 3A includes a front view and FIG. 3B includes a back view of the archery target launching device 200.

As generally shown, the archery target launching device 200 can include components similar to the first embodiment target launching device 100. A frame and a launch assembly can be integrated together to form the target launching device 200. Some components of the target launching device 200 are called out in FIGS. 3A-3B, but it is to be appreciated that components not specifically called out can be substantially similar to the components of the first embodiment archery target launching device 100.

The frame can include 3 frame members 210. The frame members 210 can form a semi-cylindrical shape with a substantially triangular cross-section. Archery targets can be sized to fit within the frame members 210 while one of the frame members 210 can be implemented to stop the targets from passing through the frame. An overall height of the target launching device 200 can be shorter than an overall height of the first embodiment target launching device 100. The archery target launching device 200 can be implemented in a horizontal orientation and in a vertical orientation. In either orientation, a first wheel 226 can be implemented to launch targets from the device 200.

As shown in FIG. 3A, components of a target guide assembly, similar to the first embodiment target guide assembly 136, can include a pair of base members 238 that can provide a surface for a target to rest on before being launched. As shown, the base members 238 can be narrow to minimize the loss of velocity due to friction between the base members 238 and a target. An overall shape of a support member 214 can be similar to a shape of plate of the target launching device 200.

As shown in FIG. 3B, a tension spring 232 can be coupled to the lid 230. The lid 230 can be moved along a length of a pair of guide members 234. As can be appreciated, as the lid 230 can be moved upwards, the tension spring 232 can extend and stretch and a compressive force can be created as the spring 232 is stretched. Although not shown in FIGS. 2A-2D, the tension spring 132 can be implemented substantially similar to the tension spring 232 shown in FIG. 3B. The compressive force can be implemented to push the lid 230 against the target(s). A target engagement member 222 is shown in a non-engagement location. When a first motor 224 that can be operatively connected to the target engagement member 222 may be activated, the target engagement member 222 can be configured to make a complete rotation during which a distal end of the target engagement member 222 can engage a target in the target storage mechanism 220. The target engagement member 222 can be sized to push the target forward enough to engage a wheel 226.

As previously mentioned, a target can be adapted to pass through the first wheel 226 and a second wheel 229. The second wheel 229 can help ensure that the target engages the first wheel 226 and prevent the target from moving laterally away from the first wheel 226. The first wheel 226 can be operatively connected to a motor 228 which may rotate the first wheel 226. The second wheel 229 can be configured to freely rotate allowing a target to engage and move past the second wheel 229 as the first wheel 226 engages and launches the target.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

In one embodiment, the components of archery target launching device can be scaled to work with a metal disc having an approximately 6" diameter. The metal discs can be implemented for small caliber firearms. In such an embodiment, the metal discs may be launched from the target launching device to allow a firearm user to engage in target practice. It is to be appreciated that some components may need to be modified for use with the metal discs.

I claim:

1. A target launching device comprising:

a launch assembly adapted to store and launch a target; and a frame defined by:

a base plate with two adjacent sides having rounded corners;

a plurality of frame members extending from a top side of the plate and forming a substantially "U" shape;

a support member coupled to distal ends of the plurality of frame members, the support member having a substantially "U" shape and sized similarly to the two adjacent sides having rounded corners of the base plate; and a plurality of legs located on a bottom side of the plate;

wherein (i) the frame is substantially vertical in a first orientation and is substantially horizontal in a second orientation, and (ii) the target launching device is supported by the plate and the support member and rollable in the second orientation.

2. The target launching device of claim 1, wherein in the first orientation the target launching device is supported by the plurality of legs.

3. The target launching device of claim 1, wherein the frame is adapted to be rolled approximately 110 degrees when in the second orientation.

4. The target launching device of claim 1, wherein the launch assembly is defined by:

a target storage mechanism;

a target engagement member;

a wheel;

a first motor operatively connected to the target engagement member; and a second motor operatively connected to the wheel.

5. The target launching device of claim 4, wherein the wheel is adapted to engage and launch a target.

6. The target launching device of claim 4, wherein the target engagement member is adapted to push a target to engage the wheel.

7. The target launching device of claim 4, wherein the target storage mechanism includes a lid, a tension spring, a pair of guide members, a target guide assembly, and the plurality of frame members.

8. The target launching device of claim 1, wherein the launch assembly is adapted to launch a metal disc.

9. The target launching device of claim 1, wherein at least one of the plurality of legs is adjustable in length.

10. An archery target launching device comprising:

a launch assembly; and a frame adapted to be substantially vertical in a first orientation and substantially horizontal in a second orientation, the frame defined by:

a base plate;

a plurality of frame members extending from a top side of the plate and forming a substantially "U" shape;

a support member coupled to a distal end of each of the plurality of frame members, the support member having a substantially "U" shape; and a plurality of legs located on a bottom side of the plate;

wherein the target launching device is adapted to roll and to rotate through approximately 110 degrees when the frame is in the second orientation.

11. The archery target launching device of claim 10, wherein a portion of a periphery of the base plate is shaped substantially similar to a shape of the support member.

12. The archery target launching device of claim 10, wherein the frame further includes a stabilizer adapted to stabilize the target launching device.

13. The archery target launching device of claim 10, wherein the launch assembly is adapted to launch a disc shaped target.

14. The archery target launching device of claim 13, wherein the disc shaped target is launched in a substantially horizontal orientation when the frame is in the first orientation.

15. The archery target launching device of claim 13, wherein the disc shaped target is launched in a substantially vertical orientation when the frame is in the second orientation.

16. The archery target launching device of claim 10, wherein the launch assembly includes a target guide assembly, the target guide assembly defined by:

a pair of base members adapted to interface with a first target, the pair of base members spaced apart and extending vertically from a top of the plate; and a restrictor member adapted to engage and block a second target located above the first target.

17. An archery target launching device comprising:

a frame adapted to be substantially vertical in a first orientation and substantially horizontal in a second orientation, the frame defined by:

a base plate;

a plurality of frame members extending from a top side of the plate and forming a substantially "U" shape;

a support member coupled to a distal end of each of the plurality of frame members, the support member having a substantially "U" shape; and a plurality of legs located on a bottom side of the plate;

a launch assembly integrated with the frame, the launch assembly defined by:

a target storage mechanism;

a target engagement member;

a wheel;

a first motor operatively connected to the target engagement member; and a second motor operatively connected to the wheel;

wherein the target launching device is adapted to roll and to rotate through approximately 110 degrees when the frame is in the second orientation.

* * * * *